United States Patent [19]

Everett

[11] 4,349,137

[45] Sep. 14, 1982

[54] GARMENT PRESSING MACHINES

[75] Inventor: Nicholas W. Everett, Close House, Hardraw near Hawes, Yorkshire, England

[73] Assignees: Richard Sussman; Wynne Everett, both of, Englewood Cliffs, N.J.

[21] Appl. No.: 178,152

[22] Filed: Aug. 14, 1980

[30] Foreign Application Priority Data

Jan. 25, 1980 [GB] United Kingdom ..... 8002524

[51] Int. Cl.[3] ..... D06C 15/00; D06F 71/34

[52] U.S. Cl. ..... 223/73; 38/15; 223/74

[58] Field of Search ..... 38/12, 15; 223/68–74, 223/57

[56] References Cited

U.S. PATENT DOCUMENTS

| | | | |
|---|---|---|---|
| 1,345,739 | 7/1920 | Bank | 223/73 |
| 2,110,657 | 3/1938 | Bere | 223/74 |
| 2,454,977 | 11/1948 | Richa et al. | 223/57 X |
| 3,084,838 | 4/1963 | Pearson | 223/73 |
| 3,224,654 | 12/1965 | Giuseffi | 223/57 |
| 3,317,094 | 5/1967 | Schmid | 38/15 X |
| 3,462,051 | 8/1969 | Schlenion | 223/70 |
| 3,737,080 | 6/1973 | Paris | 223/70 |
| 4,057,179 | 11/1977 | Everett | 223/73 |
| 4,163,331 | 8/1979 | Renaut | 38/12 |
| 4,199,088 | 4/1980 | Sanko | 223/70 |

FOREIGN PATENT DOCUMENTS

| | | |
|---|---|---|
| 992838 | 9/1975 | Italy . |
| 940432 | 10/1963 | United Kingdom . |
| 1119847 | 7/1968 | United Kingdom . |
| 1235572 | 6/1971 | United Kingdom . |
| 1533968 | 11/1978 | United Kingdom . |

*Primary Examiner*—Louis Rimrodt
*Attorney, Agent, or Firm*—James & Franklin

[57] ABSTRACT

A machine for pressing a garment sleeve and its associated arm hole region provided with a sleeve form for insertion into the sleeve of a garment to be pressed and a nipping member for pressing the associated arm hole region of the sleeve upon relative movement of the sleeve form and the nipping member into pressing relationship, in which the form and/or nipping member comprises a pair of sections movable generally laterally toward and away from one another to vary their respective overall sizes, that movement preferably being accomplished by wedge means inserted between the respective pair of sections.

39 Claims, 6 Drawing Figures

GARMENT PRESSING MACHINES

BACKGROUND OF THE INVENTION

This invention relates to garment pressing machines and, more particularly, to a machine for pressing a garment sleeve and its associated arm hole region.

It has previously been proposed to reduce the number of operations required to press a sleeved garment, such as a suit jacket, by pressing a sleeve and its associated arm hole region in a single operation with the jacket suspended on a dummy. The dummy includes a sleeve form or support which is inserted in the sleeve and which cooperates at its upper end with a nipping member for pressing the arm hole region. The nipping member is larger than the arm hole so that when applied to the sleeve form it traps the fabric to be pressed at the junction of the sleeve and the body of the jacket.

In this previously proposed machine both the sleeve form and the nipping member are expansible to suit different garment sizes. The mechanism for accomplishing this is complicated and its operation causes vertical movement of a shoulder support and consequent displacement of the garment relative to the sleeve form and nipping member. Reliable pressing of the full arm hole region is therefore not possible over a wide range of garment sizes.

It is an object of the present invention to obviate or mitigate the aforesaid disadvantages of the prior machine.

According to the present invention there is provided a garment pressing machine comprising a sleeve form for insertion into the sleeve of a garment to be pressed, and a nipping member for pressing the associated arm hole region of said sleeve upon relative movement of the sleeve form and the nipping member into pressing relationship, said form and said member each comprising two half sections flanking a wedge element which is position adjustable to move the half sections relative to each other and hence vary the overall size of said form or member.

The invention will now be further described by way of example only, with reference to the accompanying drawings, in which.

Figure 1:
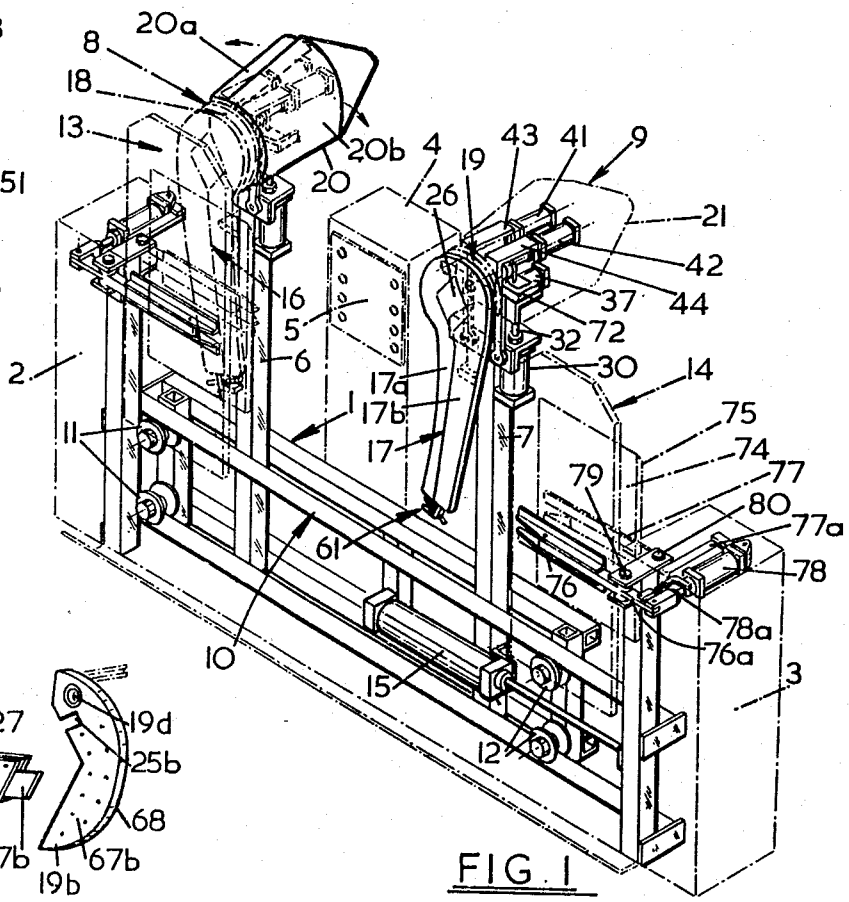
FIG. 1 is a perspective, partly broken away view of one embodiment of garment pressing machine in accordance with the invention, with twin dummies and associated presses.

Reference will now be made to FIG. 1 when used, for example, for pressing suit jackets. A frame 1 extends between left-hand (LH) and right-hand (RH) and pedestals 2, 3. A control column 4 mounted centrally between the pedestals 2, 3 has a control panel 5 on its front face. Between each pedestal 2, 3 and the control column 4 is a pillar 6, 7 carrying a respective dummy 8, 9. A carriage 10 is supported and guided by two pairs of wheels 11, 12 mounted at opposite ends of the frame 1. The carriage 10 carries presses 13, 14 which are spaced further apart lengthwise of the machine than the dummies 8, 9, whereby movement of the frame 10 from one extreme position to the other brings one press 13, 14 into alignment with the respective dummy 8, 9 for pressing and the other press 13, 14 out of alignment with the respective dummy 8, 9 to permit operator access to the dummy. For example, in the drawing the movable frame 10 is shown in its RH end position with the LH press 13 aligned and in pressing relationship with the LH dummy 8 while the RH press 14 is clear of the RH dummy 9 to enable the operator to replace the pressed jacket by an unpressed jacket. Movement of the carriage 10 is achieved by means of a double-acting pneumatic ram 15.

Each dummy 8, 9 comprises a front sleeve form 16, 17, an intermediate nipping member 18, 19 and a rear shoulder support 20, 21. As can be seen from the shape of the sleeve forms 16, 17 the LH dummy 8 is adapted to support the right half of a jacket and the RH dummy 9 is adapted to support the left half of a jacket. Apart from the differences resulting from such adaptation the dummies 8, 9 are substantially identical and the following description of their construction and mode of operation will thus be confined to the RH dummy.

Figures 2, 5, 6:
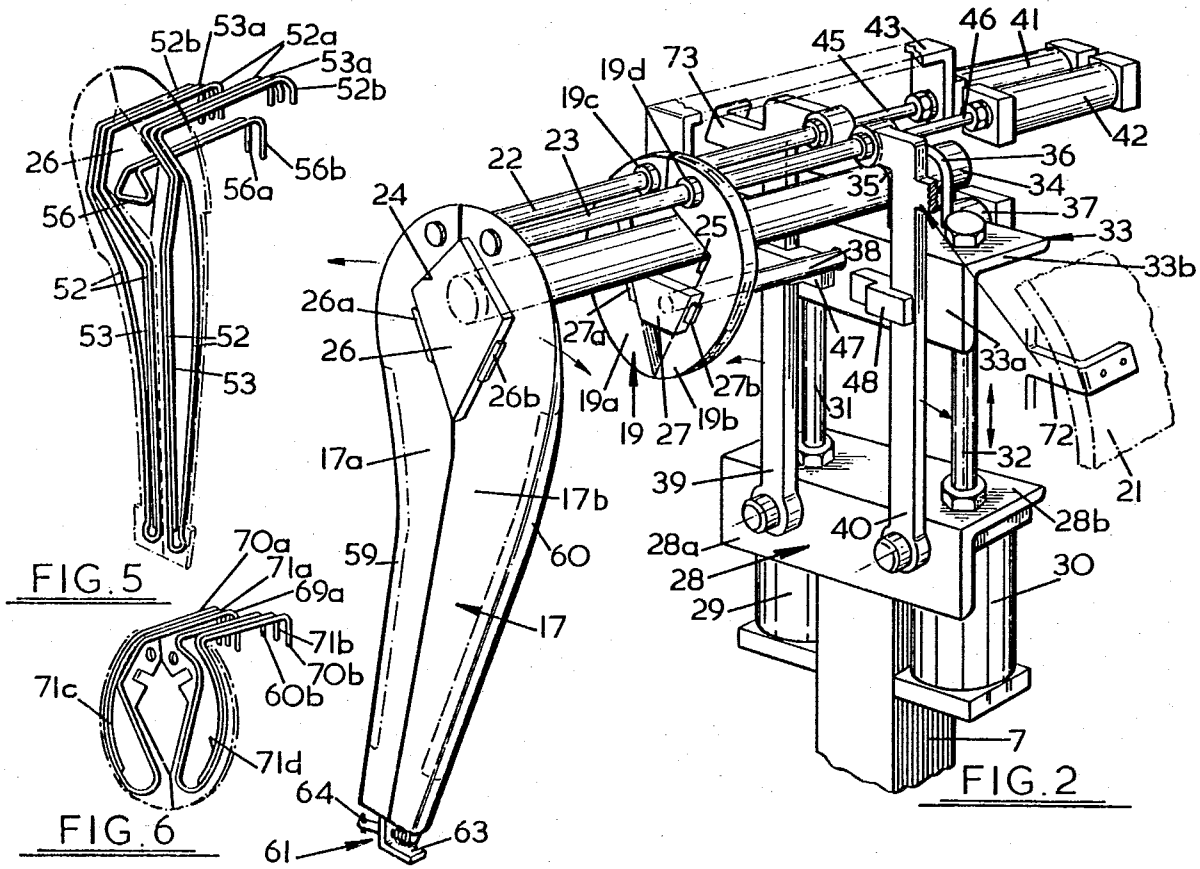
FIG. 2 is a diagrammatic perspective view to an enlarged scale showing a sleeve form and nipping member of one dummy and the operating mechanism therefor, the spacing between some of the components being exaggerated for the sake of clarity.
FIGS. 5 and 6 are diagrams showing the arrangement of pipework in the sleeve form and nipping member, respectively.

FIG. 2 shows the RH dummy partly broken away to expose the operating mechanism. The sleeve form 17 and the nipping member 19 are each divided vertically into two half sections 17*a*, 17*b* and 19*a*, 19*b*. The sleeve form half sections 17*a*, 17*b* are fixedly secured by their upper ends to the front ends of respective carrier rods 22, 23 which extend rearwardly through bearings 19*c*, 19*d* in the upper ends of the nipping member half sections 19*a*, 19*b*. The adjacent edges of the sleeve form half sections 17*a*, 17*b* and the nipping member half sections 19*a*, 19*b* are recessed to provide lozenge shaped openings 24, 25 in which are received respective wedges 26, 27. The wedge 26 is also of lozenge shape and fills the opening 24 when the sleeve form 17 is in the closed or contracted condition as shown in FIG. 2. In contrast, the wedge 27 is of prismatic shape and occupies only part of the opening 25 in which it is located. Each wedge 26, 27 is movable vertically between an uppermost position shown in FIG. 2 and a lowermost position defined by stops (not shown). Accurate location and guidance of the wedges 26, 27 is ensured by lateral projections 26*a*, 26*b* and 27*a*, 27*b* thereon engaging in slideways in the adjacent edges of the sleeve form and nipping member half sections 17*a*, 17*b*, 19*a*, 19*b*.

The mechanism for vertically displacing the wedges 26, 27 comprises a fixed support 28 provided by a section of angle iron mounted on the upper end of the pillar 7 with its forward flange 28*a* in a vertical plane and its rearward flange 28*b* in a horizontal plane. Air cylinders 29, 30 are suspended from the fixed support 28 at opposite sides of the pillar 7 and actuating rods 31, 32 thereof project upwardly through openings in the flange 28*b* for connection to a yoke 33. The yoke 33 is provided by a section of angle iron extending parallel to the fixed support 28 and oriented in the same way, i.e. with a forward flange 33*a* in a vertical plane and a rearward flange 33*b* in a horizontal plane. A beam or pipe section 34 is strapped to the horizontal flange 33*b* of the yoke 33 by U-bolts 35, 36 and extends forwardly through the opening 25 in the nipping member 19 into fixed connection with the wedge 26. Also mounted on the yoke 33 is an air cylinder 37 with an actuating rod 38 which projects through the vertical flange 33*a* of the yoke 33 and is fixed to the wedge 27 of the nipping member 19.

Two support arms 39, 40 are pivotally connected at their lower ends to the vertical flange 28*a* of the fixed support 28 and at their upper ends to the rear ends of respective carrier rods 22, 23. Associated with each support arm 39, 40 is an air cylinder 41, 42 each of which is fixed to the rear end of a respective bracket 43, 44. For the sake of clarity only the bracket 43 is shown in FIG. 2 and it will be appreciated that bracket 44, which can be seen in FIG. 1, is similarly constructed. The front end of each bracket 43, 44 is fixed to a respective half section 19*a*, 19*b* of the nipping member 19. An actuating rod 45, 46 extends from the respective cylinder 41, 42 into fixed abutting relationship with the upper end of the respective supporting arm 39, 40. Forward deflection of the supporting arms 39, 40 under the influence of the air cylinders 41, 42 is prevented by restraints 47, 48 on the vertical flange 33*a* of the yoke 33.

Figure 3:
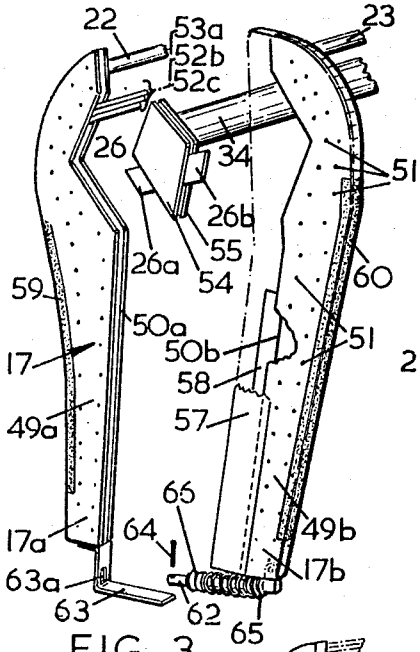
FIGS. 3 and 4 are diagrammatic exploded views of the sleeve form and nipping member, respectively.

The construction of the sleeve form 17 will now be described in greater detail with reference to FIGS. 3 and 5. The half sections 17*a*, 17*b* comprise spaced front and back plates 49*a*, 50*a* and 49*b*, 50*b* respectively with apertures 51 for the emission of steam. Steam pipes are confined between the plates and comprise in the case of each half section a heating steam pipe 52 and an apertured steam spray pipe 53 arranged in the manner shown in FIG. 5. Extending rearwardly from each half section 17*a*, 17*b* is a bundle of pipes in which 52*a* represents a heating steam supply pipe, 52*b* is a condensate return pipe and 53*a* is the spray steam supply pipe. The pipe bundles pass through notches 25*a*, 25*b* (FIG. 4) forming part of the opening 25 of the nipping member 19. The wedge 26 also has front and rear plates 54, 55 between which is confined a heating loop 56 to which steam is passed by a steam supply pipe 56*a* and from which condensate is returned by a condensate return pipe 56*b* (FIG. 5). The pipes 56*a*, 56*b* pass rearwardly through the hollow pipe section 34.

It will be appreciated that when the sleeve form 17 is expanded in the manner to be described below the half sections 17*a*, 17*b* separate to leave a gap between their adjacent edges. The exposed edges may mark the jacket sleeve during pressing and in order to prevent this cover plates 57 and 58 are attached to the front and back of the RH half section 17*b* and extend into overlapping relationship with the LH half section 17*a* during the full range of movement of the sleeve form 17. The free edges of the plates 57, 58 overlying the LH half section 17*a* are preferably chamfered to prevent this edge from marking the sleeve during pressing. The front plate 57 extends over the full height of the sleeve form 17 to close the full extent of the gap between the adjacent edges of the half sections 17*a*, 17*b* but the rear plate 58 covers only the lower part of the sleeve form 17 from the bottom end thereof up to a level immediately below the lowermost position of the pipe section 34. Rubber edging strips 59, 60 are removably fitted in rebates on the outer longitudinal edges of the sleeve form sections 17*a*, 17*b*. By selecting suitably shaped edging strips the profile of the sleeve form 17 can be varied to suit different shapes of sleeve. A cuff form 61 (FIGS. 2 and 3) is provided at the lower end of the sleeve form 17 and comprises a finger 62 mounted on the RH sleeve form section 17*b* and angled downwardly towards the LH section 17*a*. A bracket 63 is mounted on the LH section 17*a* and has an opening 63*a* therein through which the finger 62 projects. Disengagement of the finger 62 from the bracket 63 is prevented by a transverse pin 64. A compression spring 65 on the finger 62 shoulders against a fixed stop 65 and a movable collar 66 which abuts the bracket 63. A notch (not shown) in the finger 62 engages the opening 63*a* to lock the finger 62 relative to the bracket 63.

Figure 4:
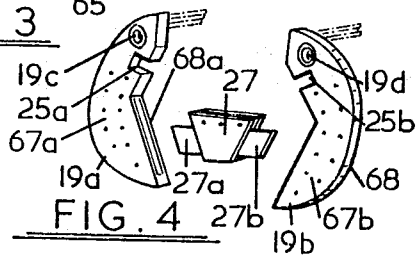

The nipping member 19, like the sleeve form 17, comprises apertured front and rear plates 67*a, b* and 68*a, b* between which are confined steam pipes (FIGS. 4 and 6). A steam supply pipe 69*a, b* for each half section 19*a*, 19*b* is connected to a condensate return pipe 70*a, b* by a heating loop 71*a, b* which follows the contour of the half section. A spray steam supply pipe 71*a, b* terminates in an apertured section 71*c, d*. The half sections 19*a*, 19*b* of nipping member 19 are slidable on the carrier rods, 22, 23 in operation and are also pivotal apart on said rods to facilitate access to the operating mechanism.

FIG. 1 shows the shoulder support 20 of the LH dummy 8 as comprising two curved plates 20*a, b* defining the LH and RH sides of the support. The plates are made of sheet metal bent to the appropriate shape and they overlap at the top central region of the support. The shoulder support 20 is arranged to expand and contract with the sleeve form 17 and the nipping member 19 so as to accept different sizes of jacket. This is accomplished by mounting each plate 20*a, b* on a respective arm 39, 40 of the operating mechanism. The connection is best seen in FIG. 2 which shows the RH half of the shoulder support 21 attached to the supporting arm 40 by way of a bracket 72. The other half of the shoulder support 21 is not illustrated but its mounting bracket is indicated at 73. In an alternative construction (not shown) the two halves of each shoulder support 20, 21 are fixed to respective half sections of the associated nipping member 18, 19. In this case the shoulder support 20, 21 will additionally follow the reciprocating movement of the nipping member 18, 19 during the pressing operation.

The sleeve form 16, 17, the nipping member 18, 19 and the shoulder support 20, 21 are each enclosed in a steam permeable bag made of stretch fabric. The resilience of the fabric provides the return force for restoring the sleeve form 16, 17 and the nipping member 18, 19 to the contracted position.

The presses 13, 14 mounted on the carriage 10 are similar in construction and only the RH press 14 will thus be described. The press comprises front and rear platens 74, 75 mounted on swing arms 76, 77. The front platen 74 extends over the full height of the sleeve form 17 while the rear platen extends only up to the region of the arm hole. Each platen 74, 75 comprises front and rear plates externally clad with fabric and confining therebetween heating and steaming pipework extending over the full area of the platens (not shown). A vacuum connection to the platens is also provided. The RH end of the swing arm 77 is cranked at 77*a* and an air cylinder 78 is mounted on the end 77*a* with its actuating rod 78*a* connected to the corresponding end 76*a* of the other swing arm 76. The arms 76, 77 are pivotally mounted on the carriage 10 at pivot points 79, 80.

The operation of the machine will now be described starting with the machine in the condition shown in FIG. 1. Assume that a jacket has just been removed from the dummy 9. The operator now hangs another jacket on the dummy 9 in readiness for pressing by the press 14 which at this stage is in an out-of-the-way position to the right of the dummy 9. The sleeve form 17 is inserted into the left sleeve of the jacket and the left shoulder is positioned on the shoulder support 21 so as to support the jacket with its arm hole in the region of the nipping member 19. The pipe section 34 is then lowered by operating the air cylinders 29, 30. The wedge 26 is thus forced between the sleeve form sections 17*a*, 17*b* and parts them to the desired extent. The carrier rods 22, 23 are consequently also separated causing splaying of the support arms 39, 40. The nipping member half sections 19*a*, 19*b* are thus moved apart as are the halves of the shoulder support 21. At the same time downward travel of the yoke 33 under the influence of cylinders 29, 30 causes downward movement of the wedge 27 and hence outward deflection of the lower ends of the nipping member half sections 19*a*, 19*b*.

When the desired extent of enlargement of the dummy has been achieved in this way, and the jacket is correctly positioned in readiness for pressing with the arm hole region located between the sleeve form 17 and the nipping member 19, the nipping member 19 is advanced into pressing relationship with the sleeve form 17 by operating the air cylinders 37, 41 and 42 whereupon the carriage 10 is moved to the left in FIG. 1 to bring the press 14 into flanking alignment with the sleeve form 17. The press 14 is then closed. The left sleeve and arm hole region of the jacket are thus pressed simultaneously. In the initial stages of the pressing operation steam is applied to soften the fabric. Dry heat is then used to set the fabric and final cooling is effected by applying vacuum to the press platens, 74, 75, and optionally blowing air through the sleeve form 17. After the press 14 has opened and the carriage 10 has moved to the right, the nipping member 19 is then retracted and the yoke 33 is raised to move the wedges 26, 27 into their starting positions and permit the sleeve form 17, nipping member 19 and shoulder support 21 to return to their contracted condition. It will be appreciated that the nipping member 19 is oversized compared to the jacket armhole and therefore does not extend through the arm hole during pressing but rather traps the full arm hole region between itself and the sleeve form 17 thereby ensuring pressing of the arm hole in a single operation.

While a jacket is being pressed on the dummy 9 in the way just described, the press 13 is clear to the left of the dummy 8 and the operator strips the pressed jacket therefrom and positions a fresh jacket thereon in the way already described for the dummy 9 save that in this case the right sleeve and shoulder are positioned on the dummy. The carriage 10 is then caused to move once more to the right and the pressed jacket is removed from the dummy 9. The sequence of operations is then repeated. By pressing each jacket successively on the two dummies 8, 9 both sleeves and arm holes thereof are pressed on the same machine.

While but a single embodiment of the present invention has been here specifically disclosed, it will be apparent that many variations may be made therein, all within the scope of the instant invention and defined in the following claims.

I claim:

1. A garment pressing machine comprising a sleeve form for insertion into the sleeve of a garment to be pressed and a nipping member for pressing the associated arm hole region of said sleeve upon relative movement of the sleeve form and the nipping member into pressing relationship, said form and said member each comprising two sections flanking a wedge element which is position adjustable to move the half sections relative to each other and hence vary the overall size of said form or member.

2. A machine as claimed in claim 1, wherein the sleeve form and nipping member are suspended from a pair of carrier rods with corresponding form and member sections on the same rod, the carrier rods being movable together and apart to permit said relative movement of the half sections as a result of vertical movement of the wedge elements, and means is provided for moving the wedge elements vertically.

3. A machine as claimed in claim 2, wherein the nipping member sections are slidable on the respective carrier rods into and out of pressing relationship with the sleeve form, and fluid pressure operated means is provided for effecting such movement and exerting a pressing force.

4. A machine as claimed in claim 1, wherein each half section of the sleeve form and nipping member comprises spaced inner and outer elements confining heating and steam spraying pipes therebetween.

5. A machine as claimed in claim 1, wherein adjacent edges of the half sections of the sleeve form overlap over substantially the full extent of their relative movement.

6. A machine as claimed in claim 1, wherein the sleeve form is provided on opposite longitudinal edges thereof with replaceable strips for determining the profile of the sleeve form in said edge regions.

7. A machine as claimed in claim 1, wherein each wedge element has lateral projections slidable in respective guides at the adjacent edges of the sleeve form and nipping member.

8. A machine as claimed in claim 1, wherein a garment shoulder support is provided adjacent the nipping member and comprises two overlapping shaped sections mounted to follow the relative movement of the sleeve form and nipping member half sections.

9. A machine as claimed in claim 1, wherein the sleeve form and the nipping member are encased in respective bags of stretch material dimensioned to suit the minimum overall size of the form and member respectively and serving to bias the form and member respectively into such condition.

10. A machine as claimed in claim 1, wherein a pair of pressing pads is associated with the sleeve form and comprises an outer pad dimensioned to fully overlap the sleeve form and an inner pad of corresponding shape and size approximately up to the level of the nipping member.

11. A machine as claimed in claim 10, wherein each pressing pad comprises spaced inner and outer elements confining heating and steam emitting pipes therebetween and having a connection for attachment of the pad to a vacuum source.

12. A machine as claimed in claim 10, wherein the pair of pressing pads is mounted on a carriage for movement into and out of alignment with the sleeve form.

13. A machine as claimed in claim 1, wherein the arrangement of sleeve form and nipping member is duplicated to enable two sleeves to be processed at the same time.

14. A machine as claimed in claim 13, wherein one sleeve form is adapted for a left sleeve and the other sleeve form is adapted for a right sleeve and the two sleeve forms are spaced lengthwise of the machine to enable two garments to be processed at the same time.

15. A machine as claimed in claim 14, wherein two pairs of pressing pads are mounted on a carriage, each pair of pressing pads being associated with a given sleeve form and comprising an outer pad dimensioned to fully overlap the sleeve form and an inner pad of corresponding shape and size approximately up to the level of the nipping member, said carriage being moveable with respect to said sleeve forms and said pairs of pressing pads being so mounted on said carriage that as said carriage moves between alternate operative positions each pair of pressing pads is moved alternately into alignment with its respective sleeve form.

16. In a garment pressing machine comprising a sleeve form for insertion into the sleeve of a garment to be pressed and a nipping member for pressing the associated arm hole region region of said sleeve upon relative movement of the sleeve form and the nipping member into pressing relationship, the improvement which comprises said form comprising a pair of sections movable generally laterally toward and away from one another to vary the overall size of said form, said member comprises a pair of sections movable generally laterally toward and away from one another to vary the overall size of said member, means operative on said form sections to thus move them, means operative on said member sections to thus move them, and a garment shoulder support connected to and movable laterally with at least one of said sections.

17. The machine of claim 16, in which said shoulder support is in two parts, one connected to each section of a pair of sections.

18. The machine of claim 17, in which said shoulder support parts overlap throughout at least the major portion of the movement of said sections.

19. The machine of claim 16, in which said garment shoulder support is connected to one of said member sections.

20. The machine of claim 19, in which said shoulder support is in two parts, one connected to each of said member sections.

21. The machine of claim 20, in which said shoulder support parts overlap throughout at least the major portion of the movement of said sections.

22. In a garment pressing machine comprising a sleeve form for insertion into the sleeve of a garment to be pressed and a nipping member for pressing the associated arm hole region of said sleeve upon relative movement of the sleeve form and the nipping member into pressing relationshp, the improvement which comprises at least one of said form and member comprising a pair of sections movable generally laterally toward and away from one another to vary the overall size of said form, means operative on said sections to thus move them, and a garment shoulder support connected to and moving laterally with at least one of said sections.

23. The machine of claim 22, in which said member comprises said pair of sections and said shoulder support is connected to at least one of said member sections.

24. The machine of claim 23, in which said shoulder support is in two parts, one connected to each section of a pair of sections.

25. The machine of claim 24, in which said shoulder support parts overlap throughout at least the major portion of the movement of said sections.

26. The machine of claim 22, in which said shoulder support is in two parts, one connected to each section of a pair of sections.

27. The machine of claim 26, in which said shoulder support parts overlap throughout at least the major portion of the movement of said sections.

28. In a garment pressing machine comprising a sleeve form for insertion into the sleeve of a garment to be pressed and a nipping member for pressing the associated arm hole region of said sleeve form upon relative movement of the sleeve form and the nipping member into pressing relationship, the improvement which comprises said member comprising a pair of sections movable generally laterally toward and away from one another to vary the overall size of said form, and externally controlled means operative on said sections to thus move them.

29. The machine of claim 28, in which said moving means comprises a wedge means operatively connected between said pair of sections, and means for moving said wedge means generally vertically, thereby to move said sections generally laterally.

30. In a garment pressing machine comprising a sleeve form for insertion into the sleeve of a garment to be pressed and a nipping member for pressing the associated arm hole region of said sleeve upon relative movement of the sleeve form of the nipping member into pressing relationship, the improvement which comprises said form and said member each comprising a pair of sections movable generally laterally toward and away from one another to vary the overall size of said form, and externally controlled means operative on said sections to thus move them.

31. The machine of claim 30, in which said moving means comprises a wedge means operatively connected between said pair of sections, and means for moving said wedge means generally vertically, thereby to move said sections generally laterally.

32. The machine of claim 30, in which said moving means comprises wedge means operatively connected between the lower portions of both pairs of sections, means for moving said wedge means generally vertically, thereby to move said lower portions of said sections generally laterally, the upper portions of the respective sections of each pair being operatively connected for simultaneous lateral movement.

33. In the machine of claim 30, means connecting the upper portions of one pair of sections to the upper portions of the sections of said other pair respectively, thereby to cause the upper portions of corresponding sections of said pairs to move laterally in unison, said means operative on said sections comprising means for spreading the lower portions thereof.

34. The machine of claim 33, in which said means operative on said sections to move them comprises wedge means moving generally vertically.

35. The machine of claim 33, in which said means for moving said wedge means active on said one pair of sections passes freely through said other pair of sections, and in which said means for moving said wedge means active on said other pair of sections is separated from said first mentioned wedge moving means.

36. Anyone of claims 16, 22, 28 or 30, wherein adjacent edges of an associated pair of sections overlap over at least the major portion of the movement of said sections.

37. Anyone of claims 16, 22, 28 or 30, wherein said form is provided on opposite longitudinal edges thereof with replaceable strips for determining the profile of said form in said edge regions.

38. Anyone of claims 16, 22, 28 or 30, wherein said form and member are encased in respective bags of stretch material dimensioned to suit the minimum overall size of the form and member respectively and serving to bias the form and member respectively into such condition.

39. Anyone of claims 16, 22, 28 or 30, wherein a pair of pressing pads is associated with the sleeve form and comprises an outer pad dimensioned to fully overlap the sleeve form and an inner pad of corresponding shape and size approximately up to the level of the nipping member.

* * * * *